US005789019A

United States Patent [19]

Vigano

[11] Patent Number: 5,789,019

[45] Date of Patent: Aug. 4, 1998

[54] METHOD FOR PROTECTING AGAINST FORGERY SHEET-LIKE PRINTED DOCUMENTS

[75] Inventor: Vittorio Vigano, Milan, Italy

[73] Assignee: Alagao Aktiengesellschaft, Triesen, Liechtenstein

[21] Appl. No.: 503,456

[22] Filed: Jul. 17, 1995

[51] Int. Cl.[6] ..... B41M 3/14; B44F 1/12; B05D 5/00

[52] U.S. Cl. ..... 427/7; 427/157; 427/161; 427/197; 427/198; 427/201; 427/203

[58] Field of Search ..... 427/7, 197, 201, 427/203, 161, 157, 158, 198

[56] References Cited

U.S. PATENT DOCUMENTS

| | | | |
|---|---|---|---|
| 1,353,720 | 9/1920 | Carualho | 427/7 |
| 2,067,988 | 4/1937 | Smith | 427/7 |
| 2,229,155 | 1/1941 | Wenker | 427/7 |
| 3,713,861 | 1/1973 | Sharp | 427/7 |
| 3,886,083 | 5/1975 | Laxer | 427/7 |
| 4,037,007 | 7/1977 | Wood | 427/7 |
| 4,143,891 | 3/1979 | Neubauer | 427/7 |
| 4,360,548 | 11/1982 | Skees et al. | 427/7 |
| 4,397,483 | 8/1983 | Hiraishi et al. | 282/27.5 |
| 4,462,039 | 7/1984 | Small et al. | 427/7 |
| 4,629,630 | 12/1986 | Devrient | 427/7 |
| 4,636,818 | 1/1987 | Jerabek | 346/213 |
| 4,662,651 | 5/1987 | Mowry, Jr. | 283/70 |
| 4,936,607 | 6/1990 | Brunea et al. | 283/70 |
| 5,114,735 | 5/1992 | Rua, Jr. et al. | 427/7 |

OTHER PUBLICATIONS

*Webster's Third New Internation Dictionary*, unabridged., Gove et al, ed. G&C Merrian Company, Pub., Springfield, MA. excerpt. pp. 2631–2632, 1966 (no month).

*Dizimario Di Ingeneria* (*Engineering Dictionary* ), published by UTET p.44 (excerpt)—translation provided no date.

*Dizimano Technico Industriale* (Technical Industrial Dictionary) published by UTET, excerpt p. 1072 no date.

*Webster's 9th New Collegiate Dictionary*, (1990 no month) excerpt p. 248.

Hawley, ed., *The Candensed Chemical Dictionary, 10th ed;* Van Nostrand Reinhold Co., (1981—no month) p. 502–503.

J. Grant, ed, *Hackh's Chemical Dictionary*, 3rd ed., McGraw-Hill book Co., Inc., N.Y. (1944—no month ) p. 382–653.

*Primary Examiner*—Marianne Padgett

*Attorney, Agent, or Firm*—Bucknam and Archer

[57] ABSTRACT

A method for protecting against forgery a printed document comprises the step of applying on the document, during the printing thereof, a microcapsule layer. This layer comprises microcapsules including a chemical product adapted to release an indelible mark which reveals tampering on surfaces portions of a document subjected to a pressing or rubbing tampering force.

7 Claims, No Drawings

METHOD FOR PROTECTING AGAINST FORGERY SHEET-LIKE PRINTED DOCUMENTS

BACKGROUND OF THE INVENTION

The present invention relates to a method for protecting papers and documents from forgery.

As is known, a problem yet to be satisfactorily solved is that to detect forgering or tampering of valuable documents, such as checks, from which ill-disposed persons frequently cancel portions and counterfeit amount numbers and words, with obvious bad consequences.

Prior anti-forgering methods conventionally provide to use transparent paints, to protect numbers and words from being mechanically removed.

However, said protective paints can be easily removed by solvents, without leaving any marks of falsification.

Another prior solution provides to apply a transparent film, coated by an adhesive, which is bound to the document to protect regions of the document where have been written numbers and words.

On the other hand, such a protective film can be easily removed by thermal shocks, that is by subjecting the document to very low temperature, so as to easily counterfeit it.

Another kind of frequently performed counterfeiting process is the copying of a valuable document by laser copying machines.

Such a counterfeiting process, owing to the very high accuracy level achieved by those machines, can provide a document actually identical to the original document.

SUMMARY OF THE INVENTION

Accordingly, the aim of the present invention is to overcome the above mentioned drawbacks, by providing a method for protecting papers and documents from forgering which allows to leave an indelible mark on tampered regions of the document and by which method an effacing of numbers or words can be easily detected.

Within the scope of the above mentioned aim, a main object of the present invention is to provide a protective method to apply to papers and documents a protective chemical product so that a subsequent re-application thereof can be easily detected, thereby making a counterfeiting of the document practically impossible.

According to one aspect of the present invention, the above mentioned aim and objects, as well as yet other objects, which will become more apparent hereinafter, are achieved by a method for protecting valuable printed papers and documents from forgering, characterized in that said method comprises the step of applying on a valuable document being printed, a layer of microcapsules including a chemical product, adapted to release an indelible track on surface portions of said document as said portions are subjected to a mechanical pressing or rubbing action.

Further characteristics and advantages of the invention will become more apparent hereinafter from an examination of the following detailed disclosure of the method according to the invention which, substantially, comprises the step of applying on the document, formed by a paper or other material sheet element, during the printing thereof, a protective layer of said microcapsules.

The mentioned chemical product can be provided as an aqueous solution, but it is preferably used in the form of an oil-wax dispersion providing the following effects:

(a) the wax penetrates the support, thereby, to remove it, it would be necessary to use a solvent which would also dissolve the ink;

(b) if it is not fully removed, then a successively applied chemical product could not be properly anchored.

The chemical product operates to detect pressing marks on surface portions subjected to a mechanical pressing and/or rubbing tampering effort.

By considering, merely as a not limitative example, the case of bank checks, on the regions where a user writes numbers and letters, the chemical product would provide a corresponding variation in the material of the document, so as to make a falsification impossible.

The chemical product, in particular, is provided in a microcapsule form and dispersed in waxy carrier materials, which will be hot applied on the document.

A hot application of the microcapsules, however, is very difficult, since if the microcapsules are heated to a temperature greater than 100° C. for some seconds, then the waxy carrier thereof will melt so as to irremediably damage the microcapsule chemical product.

Moreover, said microcapsules must not be fully embedded in the waxy material, since, in such a case, they would not be suitable for detection.

Moreover, they can not be applied on the surface of the document, since, in such a case, they could be easily removed and damaged.

It has been found an optimum ratio between the melting temperature (about 85° C.–90° C.) and the cooling temperature (about 5° C.–12° C.) of the chemical product.

The heating and the successive cooling of the waxy carrier could also unfavorably affect the micro and macro crystalline structure of said waxy carrier material.

An insufficient amount of product will negatively affect the detection and would not allow to properly detect possible pressure marks; on the other hand, if the amount is excessive, irregular spots will be generated.

An optimum amount of the chemical product, applied as a protective layer, would be of 4–7 g/m$^2$, depending on the concentration of the microcapsules.

The chemical product is applied by a screen printing method, i.e. not through the overall surface, but by spots, in order to facilitate the writing on the document by conventional ball-point pens, fountain pens, and so on and to make a falsification more difficult.

In the case of non absorbing material documents (such as, for example, plastic films), the subject microcapsule chemical product can be anchored exclusively by heating (by changing the surface tension both of the product and of the support).

This hot application causes the microcapsule chemical product to practically penetrate the document in a controlled and even manner.

Thus, it would not be possible to reapply it on tampered regions, since, upon subsequent cold application of a microcapsule protective layer, the document could not be recovered to its starting condition, thereby detecting a possible falsification.

In the case in which, after having counterfeited a document, one would attempt to reapply the protective waxy layer and the document would be subjected to a thermal processing, then halos and spots would appear, which would make the falsification apparent, thereby nullifying any efforts to bring the document to its starting outer aspect.

Another important feature of the present invention is that the protective layer as above disclosed further includes s fluorescent and/or sensitive ink, which can be applied on the document either before or after the printing thereof.

The fluorescent inks are adapted to prevent the document from being photostatically copied in high definition laser printers, since these laser printers are not adapted to apply fluorescent and sensitive inks.

Moreover, these inks would react in the presence of solvents and/or acids.

Advantageously, the fluorescent and/or sensitive inks can be applied by a screen printing process, adapted to firmly anchor said inks on their support.

In particular, a removal of a fluorescent ink to counterfeit the document, can be easily detected by conventional Wood lamps (i.e. lamps irradiating light of wavelength lower than 400 manometers).

Moreover, a printed fluorescent ink would allow to neutralize the chemical product waxy material which, as spread on the wording or number side, would prevent anchoring of ball pen inks and the like.

It should be moreover pointed out that the method according to the invention also provides to use, as a tampering detecting chemical product, carbon sulfide microcapsules which can be applied either before or after printing.

Alternatively, it would also be possible to use solvents, or plasticizing materials, adapted to make the paper transparent, either of the microcapsule type or not.

In this connection it should be moreover pointed out that the document will be checked by transparency and it will be performed on the two faces of the document, so as to allow to detect possible not transparent regions.

It is also possible to use an optical system adapted to measure the reflection angle, but it would be more expensive.

As an already printed or written document is subjected to a further tampering printing or writing operation, then the microcapsules will be broken to release the chemical product therein which, by combining with the paper material, will make the latter transparent, thereby providing indelible tampering marks.

For a greater safety, it is also possible to use a relief type of printing.

From the above disclosure it should be apparent that the invention fully achieves the intended aim and objects.

In particular, the fact is to be pointed out that an anti-forgery method has been provided which allows to easily apply a microcapsule protective layer to papers or documents to be protected.

These microcapsules, if broken for further writing on the document, would leave an indelible mark, by releasing the chemical product therein.

For detecting a possible falsification, it is possible to use the following system:

1) introduction of the document provided with the above disclosed protective microcapsule layer in a suitable designed chemical-optical detector, in which the document will be sprayed or coated by a glycerophthalic resin based product which would react with the chemical product released by the crushed microcapsules of the protective layer thereby allowing to clearly detect the falsification, 2) coating on the document portion to be written upon said glycerophthalic based product, either in a microcapsule form or not, dissolved in a suitable solvent, adapted to make the support transparent.

In the first case, since it would be possible to remove the pigment of the broken microcapsules by a laser beam, the detection of a possible falsification by the mentioned glycerophthalic product should be performed as the document is checked and accordingly for a single time.

In fact, exclusively in this manner it would be possible to detect a damage of the document, caused for example by the laser beam.

In order to prevent rubbing operations from damaging the microcapsules, the broken microcapsule detecting product should be applied on the support by atomizing it with a liquid/gas ratio of substantially ½.

The resin of the detecting product must be dissolved in a solvent adapted to penetrate the support, that is said resin should not be removable without damaging the fluorescent ink.

This solvent could comprise isopropyl alcohol and/or acetone or other glycols or acetates.

A possible effacing by a mechanical abrading operation would easily allow to detect the falsification, for example by view of suitable tools.

The invention as disclosed is susceptible to several modifications and variations, all of which will come within the scope of the inventive idea.

We claim:

1. A method for protecting printed papers and documents against forgery, comprising a step of applying on a document, during a printing thereof, a protective breakable microcapsule layer, said layer including a plurality of breakable microcapsules containing a chemical product adapted to leave an indelible mark on a surface portion of said document as said document is subjected to a tampering force causing said breakable microcapsules to be broken, said breakable microcapsules having a melting temperature of 85° C.-90° C. and being dispersed in a not fully embedded condition in a waxy material, said waxy material, with said breakable microcapsules dispersed therein, being applied on said surface portion of said document at a temperature less than 100° C. such that said microcapsules are not damaged thereby, said breakable microcapsules being applied in an amount from 4 $g/m^2$ to 7 $g/m^2$ on said document, said method further comprising a step of applying fluorescent inks on at least a surface of said document, such that an attempt to remove said waxy material by means of solvent will dissolve the printing ink used in said printing.

2. The method according to claim 1, wherein said chemical product is adapted to make said document transparent as said chemical product is released as said breakable microcapsules are broken under a mechanical writing stress.

3. The method according to claim 2, wherein said chemical product comprises a carbon sulfide.

4. The method according to claim 2, wherein said chemical product comprises oil based solvents.

5. The method according to claim 2, wherein said chemical product comprises plasticizing substances.

6. The method according to claim 2, which further comprises the step of coating said document with a glycerophthalic resin based product adapted to react with the chemical product released by the broken microcapsules.

7. The method according to claim 2, which further comprises the step of coating said document with a glycerophthalic resin based product dissolved in a suitable solvent, said glycerophthalic resin based product adapted to react with the chemical product released by the broken microcapsules.

* * * * *